US007823242B2

(12) United States Patent
Gorman

(10) Patent No.: US 7,823,242 B2
(45) Date of Patent: Nov. 2, 2010

(54) REMOTE CONTROLLED APPARATUS FOR CLEANING OF OUTER WINDOW SURFACES OF HIGH RISE BUILDINGS AND BUILDING FACADES

(76) Inventor: Daniel J. Gorman, 740 Lonsdale Road, Ottawa, Ontario (CA) K1K 0K2

( * ) Notice: Subject to any disclaimer, the term of this patent is extended or adjusted under 35 U.S.C. 154(b) by 826 days.

(21) Appl. No.: 11/802,974

(22) Filed: May 29, 2007

(65) Prior Publication Data

US 2008/0295265 A1 Dec. 4, 2008

(51) Int. Cl.
*A47L 1/02* (2006.01)

(52) U.S. Cl. ..... 15/103; 15/250.11; 15/50.1; 15/98

(58) Field of Classification Search ..... 15/4, 15/49.1, 50.1, 50.2, 50.3, 98, 103, 250.11
See application file for complete search history.

(56) References Cited

U.S. PATENT DOCUMENTS

| | | | | |
|---|---|---|---|---|
| 4,025,984 | A | 5/1977 | Hoener, Jr. | 15/302 |
| 4,198,724 | A | 4/1980 | Fisher et al. | 15/302 |
| 5,249,326 | A | 10/1993 | Jefferies et al. | 15/50.1 |
| 6,851,156 | B1 | 2/2005 | Hairaton | 15/250.01 |
| 7,007,334 | B2 | 3/2006 | Thurnher | 15/103 |
| 7,523,517 | B2 * | 4/2009 | Yu | 15/103 |
| 2006/0048800 | A1 | 3/2006 | Rast et al. | 134/56 |

* cited by examiner

*Primary Examiner*—Shay L Karls

(57) ABSTRACT

The invention disclosed relates to the remote cleaning of outer surfaces of windows or facades of high rise buildings without the need for workers located outside the building wall. In fact, the cleaning operation effectively duplicates the conventional manual cleaning operation, such that a minimum of cleaning liquid is used, and no means is required for removal of excess cleaning liquid. The apparatus comprises a rectangular master frame and a parallelogram sub-frame contained therein, suspended from the top of the building to a position opposite a window to be cleaned. A novel cleaning tool, including mechanical scrubbing means e.g. a brush and mechanical scraping means e.g. squeegee and a washing liquid spray means, is carried on an insertion tool attached to the parallelogram sub-frame, and brought to bear against the window outer surface to be cleaned, as required. The brush and squeegee are rotatable and moveable in any desired planar motion in the plane of the window surface, which is not possible with any known remotely operated window cleaning apparatus. The entire cleaning operation is effected and monitored by an operator in a safe remote location, for example, by means of closed circuit television.

17 Claims, 17 Drawing Sheets

REMOTE CONTROLLED APPARATUS FOR CLEANING OF OUTER WINDOW SURFACES OF HIGH RISE BUILDINGS AND BUILDING FACADES

FIELD OF THE INVENTION

This invention relates to a remotely operated high rise building window and facade cleaning apparatus, and in particular to a remotely operated window glaze cleaning apparatus.

BACKGROUND OF THE INVENTION

The conventional method for cleaning the outer glazed surfaces of sealed windows of high rise buildings is by means of a manual operation by workers in a swing stage (sometimes referred to as a cradle or balcony) which the workers can raise or lower along the side of the building to a position opposite the window glaze to be cleaned. The conventional cleaning method involves two steps. First, the glazed surface is brushed or scrubbed with a cleaning brush soaked in cleaning fluid. This step is followed by a squeegeeing or scraping operation in which the workers, using a plastic or rubber blade (squeegee) scrape all excess liquid from the glaze surface leaving it in a streak free pristine condition. In the case of buildings of intermediate height the same cleaning operation is sometimes performed by workers lowered over the side of the building in bosun chairs. Both methods of cleaning outer glazed surfaces are expensive and constitute one of the most dangerous occupations in industry.

There is a well known need for a window glaze cleaning device for cleaning glazed surfaces that are not readily accessible, such as the glazed outer surfaces of sealed windows of high rise buildings which is efficient and does not require workers on the outside of the building.

DESCRIPTION OF THE PRIOR ART

Numerous inventions have been proposed for accomplishing the cleaning of high rise building facades and/or window glaze outer surfaces by remote means. In general, mechanical devices proposed up to the present time involve the raising and lowering of a cleaning head along the building wall. As it passes along the surface to be cleaned the cleaning head sprays cleaning fluid on the surface and scrubs it with brushes. Most of these inventions involve the use of rotating, or non-rotating, brushes which are forced to travel vertically along the building facade and scrub the facade and/or outer glazed window surfaces with a liquid cleaning solution. Means are then provided for removing the remaining cleaning fluid from the glaze surface. Good discussions are to be found on prior art up to the year 1977 in U.S. Pat. No. 4,025,984, and, up to the year 1980, in U.S. Pat. No. 4,198,724.

One disadvantage of at least some known automatic window washers is that they can satisfactorily clean a window only while moving in one direction ie. either only while moving upwardly or only while moving downwardly. This results in time being wasted waiting for the apparatus to be repeatedly retracted to its starting position A second disadvantage is that they require a relatively large amount of washing liquid to clean a given window area. Because these devices generally spray the washing liquid directly on the window surface and because the scrubber brushes and removal means are generally not positioned in proximity to the location at which the washing liquid is sprayed on the window surface, a large amount of washing liquid is needed to adequately and uniformly wet the surface to be cleaned and to keep the dirt particles in suspension in the washing liquid for a sufficient length of time to enable the removal means to collect it.

Furthermore, due to the limited amount of weight supported by a suspension line support system, either (1) the window washer must be refilled quite often, or (2) the dirty waste water must be recycled, or (3) a complicated filtration system must be used to clean the waste water.

The next problem, that of removing excess fluid, is addressed by dragging a scraper, or squeegee, along the surface behind the brushes (U.S. Pat. No. 4,198,724). In other devices (U.S. Pat. No. 4,025,984) atmospheric air is caused to rush over the surface to cause evaporation of the excess fluid. This general approach is typical of most devices proposed up to this time for effecting the cleaning operation. None of these devices has been generally adopted by the high rise building cleaning industry so far.

Typical of these proposed devices is the one described in U.S. Pat. No. 4,198,724. It is of interest to compare it and its functioning with that of the present invention. This earlier device comprises a cleaning head which is to be lowered from the building roof by cable while guided horizontally by a pair of adjacent vertical mullions of the building wall. Cleaning fluid is dripped onto horizontal roller brushes which are oscillated axially while dragged along the surface to be cleaned. Plastic horizontal squeegee blades follow the rollers and their function is to scrape off excess cleaning fluid which is eventually removed by a vacuum suction system. At the end of the up or down travel the head has to be repositioned between the next pair of adjacent mullions before the cleaning process can be continued. Also, the cleaning head is designed for one window width, only, as it must be dragged or lowered vertically between pairs of adjacent mullions.

The present invention does not depend on the existence of exposed vertical mullions on the wall of the building. Furthermore it does not require the installation of any tracks or rails on the building wall as many proposed devices do (e.g. See also U.S. Pat. No. 7,007,334 B2).

SUMMARY OF THE INVENTION

Introduction

In the present invention the cleaning apparatus is lowered from the building roof and operated by remote control, e.g. with the aid of closed circuit television. The cleaning apparatus is lowered from the building roof and temporarily parked opposite the window glaze to be cleaned. The cleaning operation mimics the conventional manual process used for cleaning low level easily accessible windows. This means that a minimum amount of cleaning fluid is applied and the problem of disposing of excess fluid by suction, or other means, is avoided. The first cleaning operation, that of wetting the window with a washing liquid and scrubbing the window outer glaze surface, is performed in a manner identical to that performed manually by workers outside the window. It makes no difference whether or not the window is recessed from the building outer wall surface. With the present invention the operator is free to give smudged spots on the glaze surface extra scrubbing if required. Such detailed attention is not possible with the prior art devices discussed above. The scrubbing operation is followed by a scraping operation, again, in a manner identical to that carried out conventionally by workers located outside the window. The cleaning tools (e.g. brush and squeegee) are caused to undergo any desired planar motion in the plane of the window, and are rotated as required to work into corners and change cleaning direction. In the present invention the angle of attack between the squeegee blade and the surface to be cleaned remains substantially constant at the desired setting. Also, with the present invention brushes and squeegees of any convenient design or length may be utilized. For example, the squeegee may include replaceable scraping blades and the brush may include a replaceable brush head. They are guided over the entire glaze surface regardless of its geometry, rectangular or otherwise, just as they are in the manual cleaning of low level easily accessible windows. No remote controlled apparatus on the market today has these unique features.

According to one embodiment of the invention, a remotely operated high rise building window glaze or building facade cleaning apparatus, comprising a rigid master frame of three-dimensional open-cage rectangular shape, for in operation being placed in a position opposite and adjacent to a surface to be cleaned, an open-cage sub-frame of similar geometry and smaller dimensions, suspended within the master frame in spaced relationship therefrom, a cylindrical insertion tool attached to the sub-frame, such that its axis remains always perpendicular to the surface to be cleaned, including activation means therefor, cleaning tools attached to the insertion tool, including washing liquid spray means, mechanical scrubbing means and mechanical scraping means, wherein the mechanical scrubbing means and mechanical scraping means are rotatable and moveable in any desired planar motion in the plane of the surface to be cleaned, and remote control means for remotely operating the apparatus, such that in operation, the liquid spray means, mechanical scrubbing means and mechanical scraping means are sequentially brought to bear against the surface to be cleaned by said activation means.

According to another embodiment of the present invention there is provided a remotely operated high rise building window glaze or building facade, cleaning apparatus comprising, a rigid master frame of three-dimensional open-cage rectangular shape, adapted to be vertically lowered or raised by means of a suspension cable to and from a cleaning position opposite the window glaze or building facade to be cleaned, wherein the open-cage master frame is defined by horizontally disposed upper and lower members joined at respective upper and lower corners by vertically disposed members, and including building wall contact means attached to the inside lower corners to maintain positioning of the master frame in a stationary position during the cleaning operation, an open-cage sub-frame of similar geometry and of smaller dimensions suspended within the master frame in spaced relationship therefrom, wherein the open-cage sub-frame is defined by horizontally disposed upper and lower base members pivotably joined at respective upper and lower corners by vertically disposed members e.g. in the form of circular corner rails, and wherein the lower corners are pin jointed in such a way that in operation the lower base members pivot out from the building facade, thereby forming a parallelogram shape, a rigid two-dimensional rectangular shaped main frame defined by horizontal rails e.g. of circular form, attached at each end to vertical travelling end assemblies fitted with linear bearings, the linear bearings being slideable up and down the vertical corner rails of the sub-frame at the same rate, wherein vertical travel of the bearings is effected by a first drive system e.g. a chain-sprocket drive, the first drive system being so designed that the main frame always travels in a vertical plane, though this plane of travel will be moved horizontally outward from the building facade as the base of the sub-frame pivots outward, a carrier frame slideable horizontally along the main frame by means of linear bearings fitted on the horizontal rails of the main frame, such that horizontal motion of the carrier frame is effected by means of a second drive system e.g. chain-sprocket system mounted on the main frame, a cylindrical insertion tool mounted on the carrier frame such that its axis remains always perpendicular to the surface to be cleaned, including activation means therefor, cleaning tools attached to the insertion tool, including washing liquid spray means, mechanical scrubbing means and mechanical scraping means, such that in operation, the liquid spray means, mechanical scrubbing means and mechanical scraping means are sequentially brought to bear on the surface to be cleaned by said activation means, wherein further increasing the insertion tool travel toward the window glaze causes the sub-frame to move outward at its base thereby increasing the pressure of the mechanical scrubbing means and/or the mechanical scraping means on the surface to be cleaned to a desired level, and remote control means for remotely operating the apparatus.

In an embodiment of the invention, the apparatus additionally comprises a pair of coil springs mounted horizontally on the upper members of the master frame connected to a pair of cables, wherein the cables pass over pulleys and downward where they are connected to the main frame, In an embodiment of the invention, the mechanical scrubbing means e.g. a brush or a sponge, and mechanical scraping means e.g. a squeegee, are rotatable and moveable in any desired planar motion in the plane of the surface to be cleaned.

In an embodiment of the invention the master frame is moved up and down by a cable e.g by a single cable suspended from a single roof-mounted boom, or by a pair of cables suspended from a pair of roof-mounted booms, its movement being controlled by the remote control means.

In an embodiment of the invention, the wall contact means is in the form of pads, to provide intimate sustained contact with the building wall, such that the resulting friction forces maintain the master frame in a steady position during the cleaning operation. It will be appreciated that in some embodiments, the pads could be replaced by wheel assemblies. When pads are used, cantilevered counter weights may be attached to the master frame lower extremities, to increase the pad/building wall interaction forces to further promote steadiness. Similarly, if wheel assemblies are used the same cantilevered counter weights may be employed to increase the wheel assembly/building wall interaction forces In an embodiment of the invention, the pair of cables suspended from the pair of coil springs serve to stretch the springs and exert a vertical lifting force on the main frame substantially sufficient to neutralize the gravitational forces acting on the main frame when it is half way through its vertical travel, thus permitting substantially full vertical travel of the main frame to be effected with a minimum of force from the vertical travel drive chain system.

In an embodiment of the invention, the remote control means includes a set of remote station controls for activating two-way electric motors driving the first and second sprocket-chain drives, pressurizing or venting the insertion tool activation means e.g. an air cylinder, activating the liquid spray pump motor, and causing rotation of a two-way electric motor mounted on the insertion tool which provides for rotation of the brush and squeegee. These controls provide for any desired planar motion of the brush and squeegee in the plane of the window surface to be cleaned. While a brush or squeegee may be mounted on the same insertion tool, in a typical embodiment, two insertion tools, one above the other, or one beside the other, are employed, one carrying a brush and the other carrying a squeegee. It will also be appreciated that the liquid spray means and the mechanical scrubbing means may be mounted on the same insertion tool.

In an embodiment of the invention, the liquid spray means includes a reservoir for washing liquid and a liquid spray pump associated therewith.

In an embodiment of the invention the cleaning operation is monitored by a conventional closed circuit television system with cameras mounted as desired on the carrier frame and the master frame. A television receiver is provided at the remote control station to permit the operator to monitor and control the cleaning process.

BRIEF DESCRIPTION OF THE DRAWINGS

In the accompanying drawings which illustrate, by way of examples, embodiments of the present invention.

DETAILED DESCRIPTION OF THE INVENTION

Figure 1A:
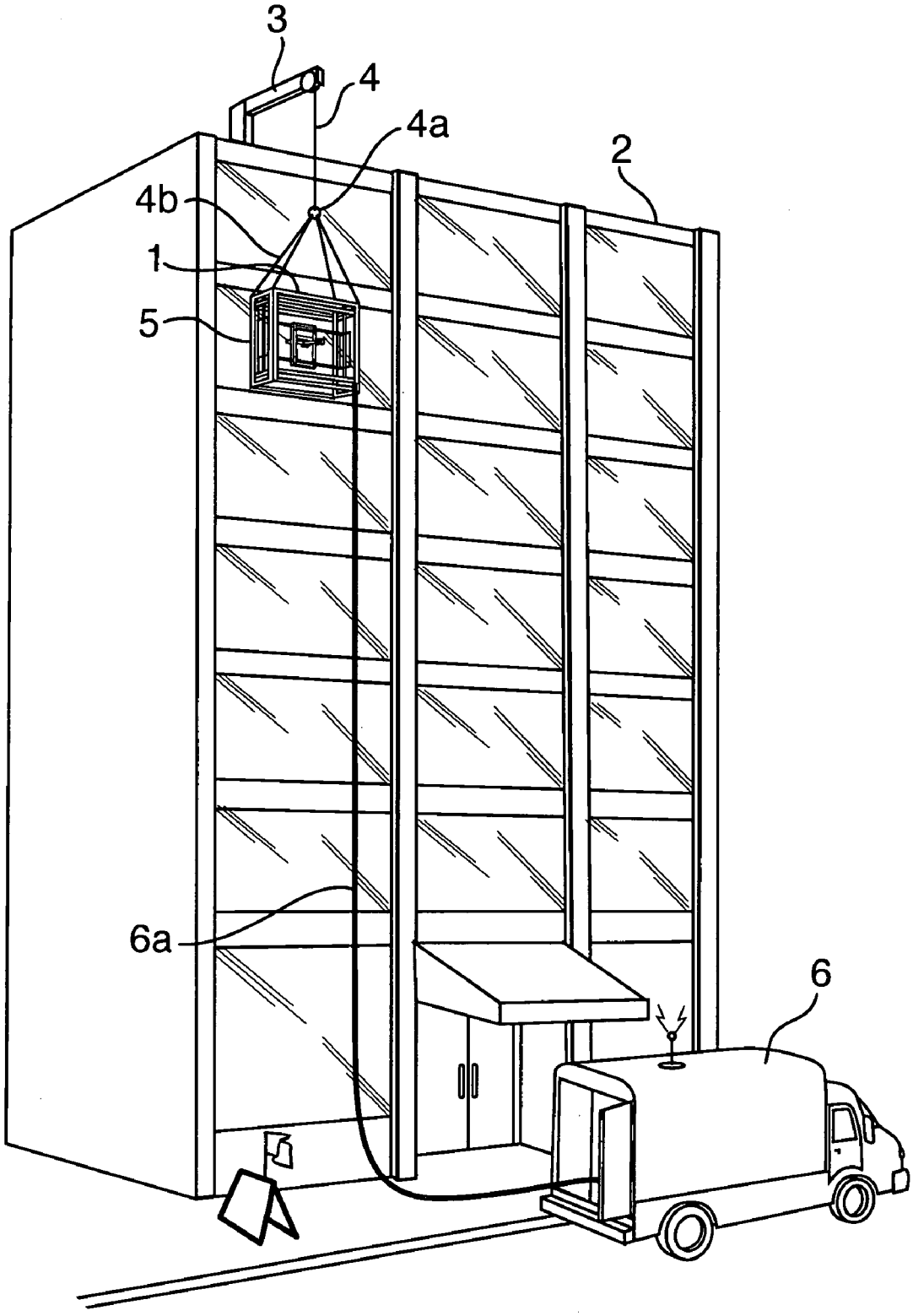
FIGS. 1A and 1B are schematic views of two embodiments of the remote operated window cleaning apparatus in service.

As seen in FIG. 1A, the remotely operated building window, or facade cleaning apparatus according to the invention generally shown as 1, is adapted to be suspended from the rooftop of a building 2 by a boom means 3 or the like mounted on the rooftop, by a cable 4. In this arrangement, a primary cable 4 is attached to a gathering block 4*a*, and four secondary cables 4*b* connect the gathering block 4*a* to the four upper corners of a master frame 5.

Figure 1B:
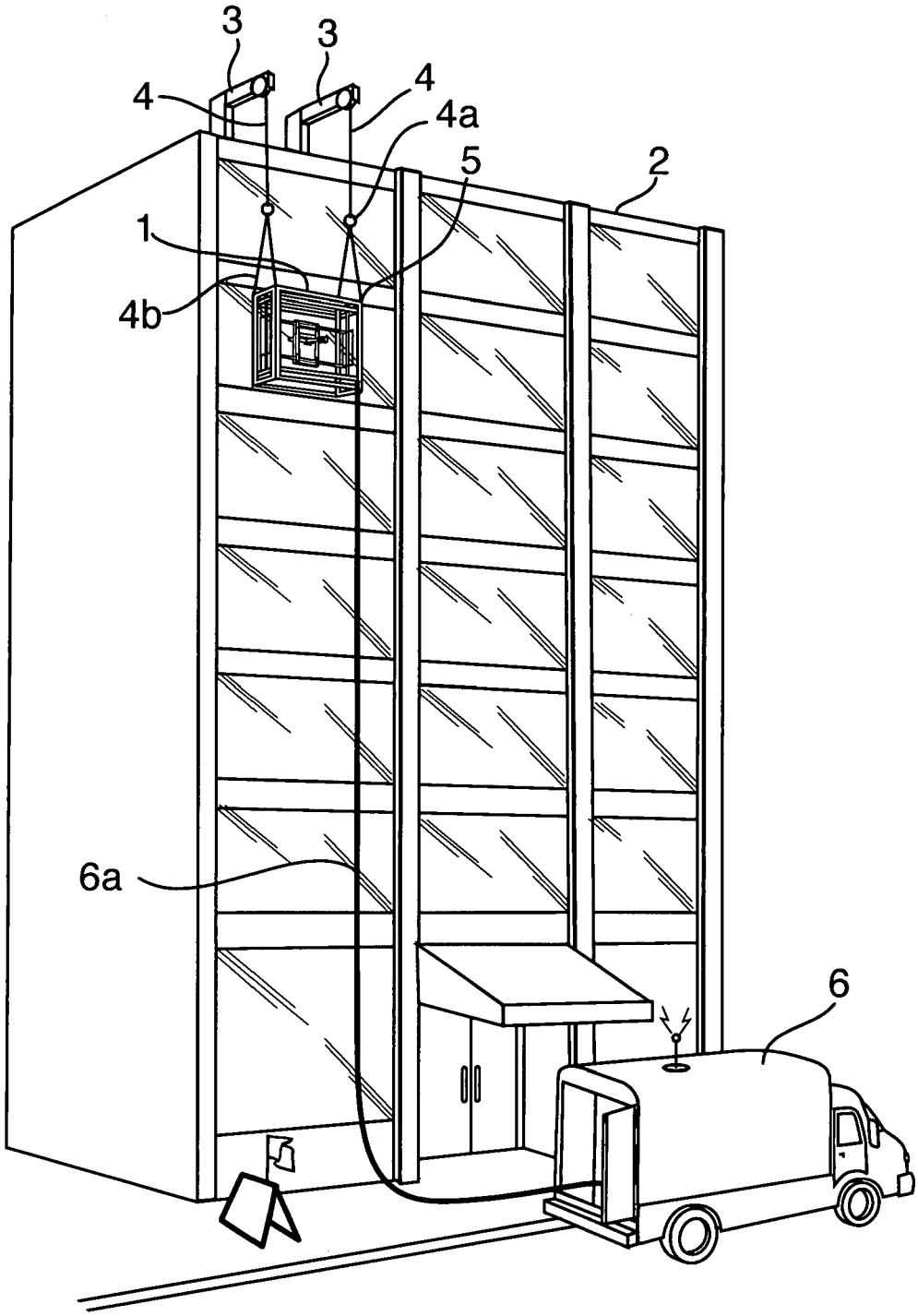

In FIG. 1B, an alternative suspension system is illustrated, wherein a pair of booms 3 are employed. A pair of primary cables 4, a pair of gathering blocks 4*a* and secondary cables 4*b* connect the gathering blocks 4*a* to the four upper corners of a master frame 5.

It will be appreciated that the apparatus according to the invention may be used to clean windows that are flush or indented from the building facade or the building wall facade itself and the like.

The boom means 3 can be adapted to travel along the rooftop eg. on a track (not shown) adjacent to the building wall to facilitate full coverage of the building wall facade.

Remote control of the operation of the apparatus according to the invention may be provided by a conventional remote control means(not shown) located in a vehicle, such as a truck 6 shown in FIGS. 1A and 1B, parked on the ground adjacent to the building. It will be appreciated that the remote location of the control means can be in any convenient location either on the ground, on the roof top or in the building. In some embodiments, a light electric cable 6*a* is used to provide electricity at domestic voltages to the apparatus. However, it is not essential that a direct electrical connection between the apparatus and the electrical power source be employed. In some embodiments, the electric power required to drive the electric motors etc, is provided by batteries e.g. rechargeable batteries carried on the master frame 5. Similarly, remote control signals may be transmitted to the apparatus by an electric cable, or they may be transmitted by means of a conventional wirelesss system.

Figure 1C:
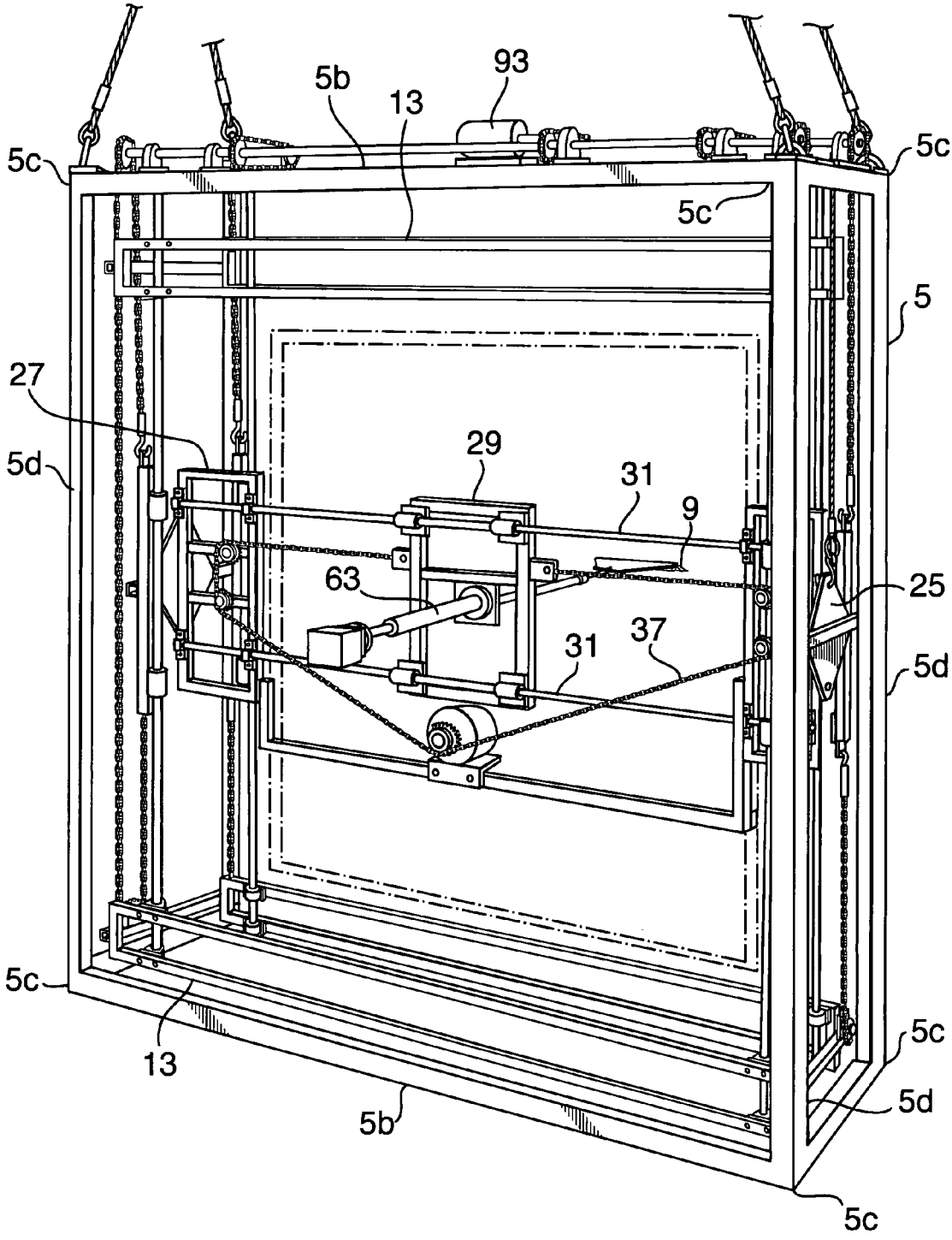
FIG. 1C is a schematic view of the apparatus according to the invention.
Figure 2:
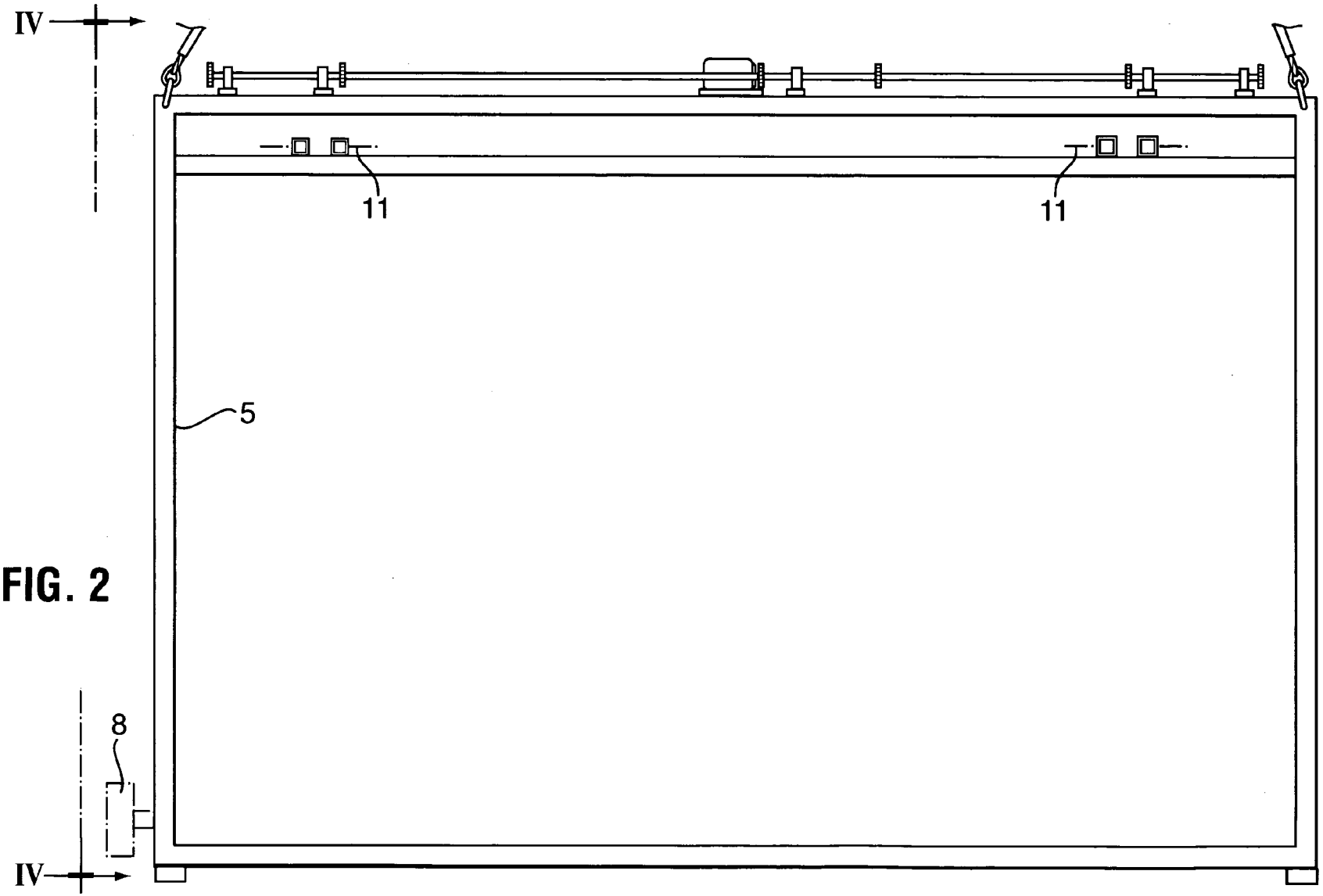
FIG. 2 is a front view of a master frame with a vertical chain drive in place.
Figure 3:
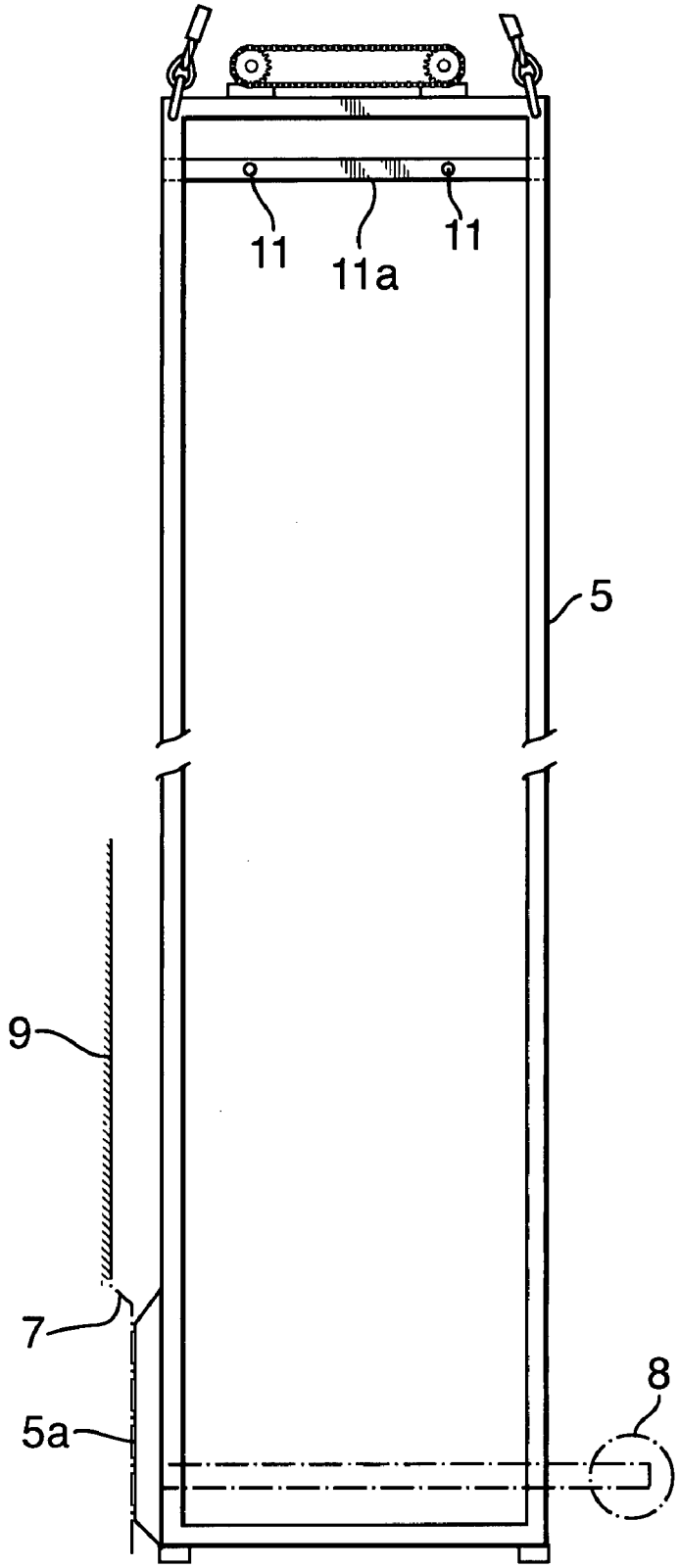
FIG. 3 is an end view taken in section along II-II in FIG. 2.

As best seen in FIGS. 1C, 2 and 3, the novel apparatus according to the invention includes a rigid master frame 5 of three dimensional open-cage rectangular shape for in operation being placed in a position opposite and adjacent to the outer glazed surface 9 of a window to be cleaned. When in position the master frame 5 makes intimate and sustained contact with the building wall 7, by a wall contact means. In this embodiment, a pair of sliding pads or shoes 5*a* mounted on the lower corners of the master frame 5. Other contact means such as wheels could also be used.

Counter weights 8, also shown in FIG. 2 and 3 are employed in some embodiments, to provide additional friction forces between the shoes 5*a* and the building wall 7, so that motion of the master frame is avoided during the cleaning operation. Also, a thin plastic sheet material may be attached to the shoes in order to increase tangential friction forces between the shoes 5*a*, and the wall 7.

In one embodiment, the master frame is defined by horizontally disposed upper and lower members 5*b* joined at respective upper and lower corners 5*c* by vertically disposed members 5*d* (see FIG. 1C), wherein the members are made of hollow-square cross-section aluminum bars welded together.

Figure 4:
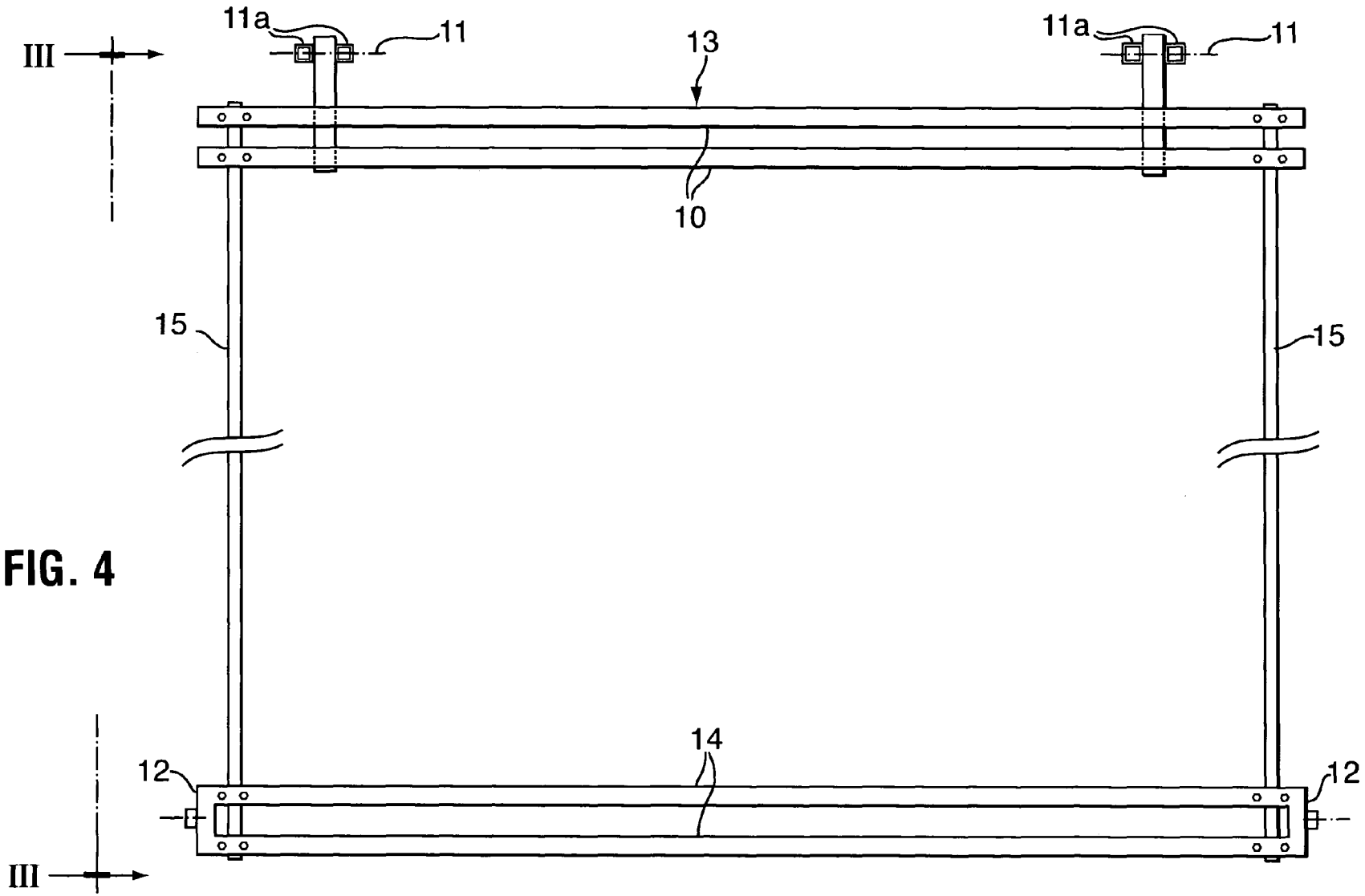
FIG. 4 is a front view of a parallelogram frame.
Figure 5:
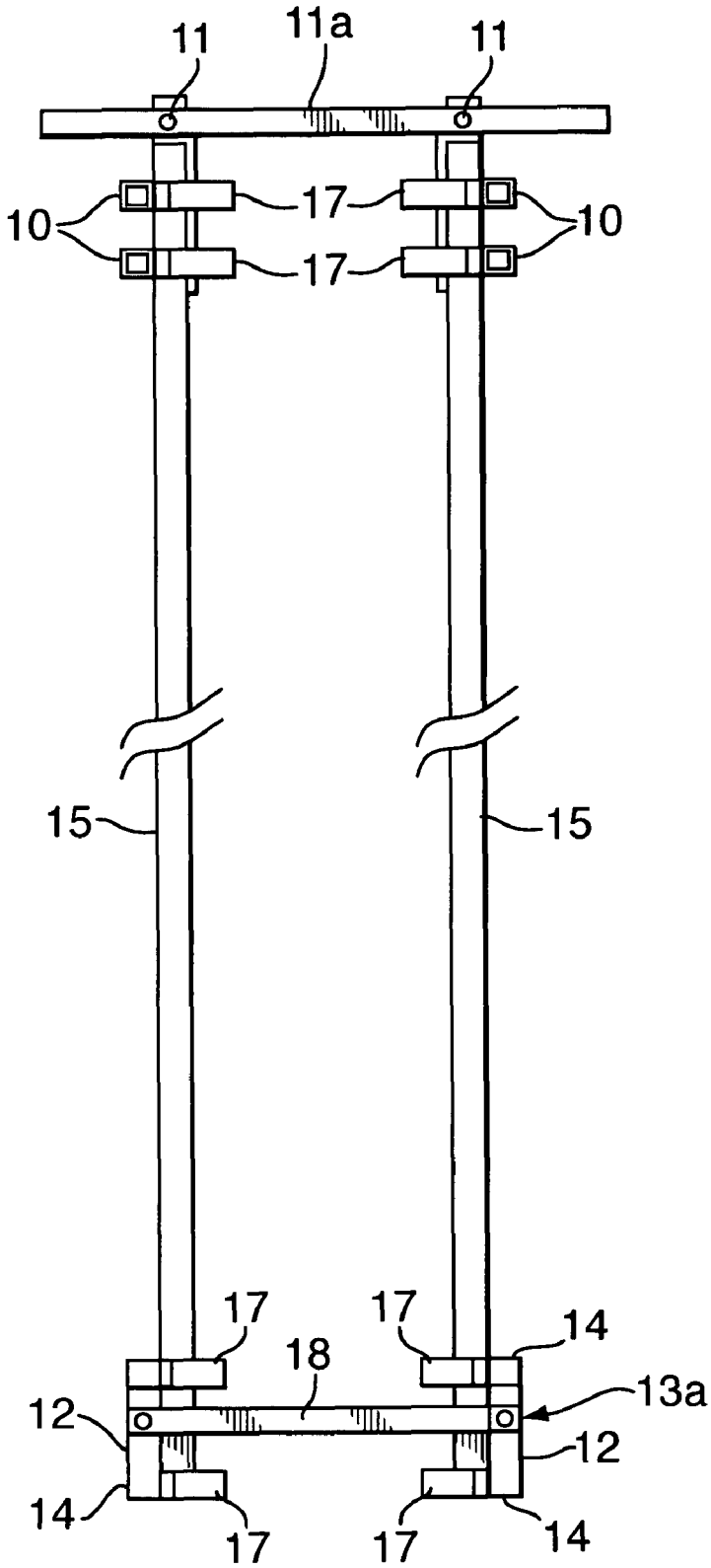
FIG. 5 is an end view taken in section along III-III in FIG. 4.
Figure 17B:
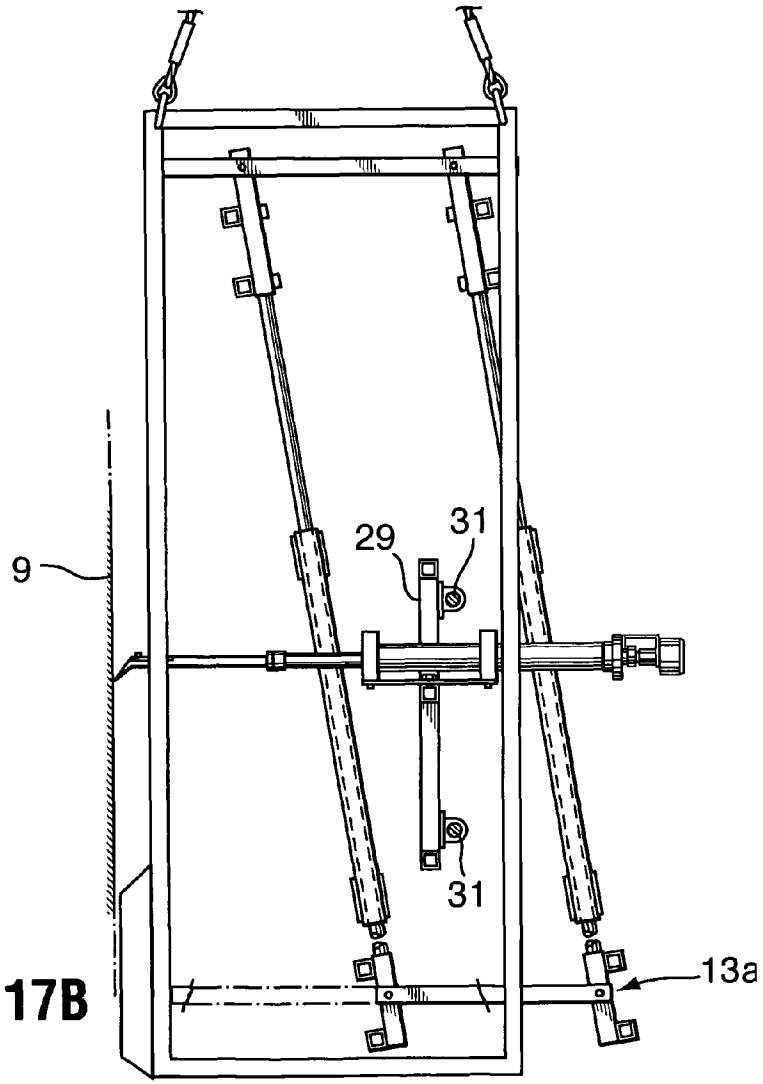
FIG. 17B is a section view taken through a remote operated window cleaning apparatus.

As best seen in FIGS. 1C, 4 and 5, the novel apparatus according to the invention includes also a parallelogram subframe 13 of three dimensional open cage parallelogram shape for in operation being suspended inside the master frame by means of pinned joints 11 connecting with cross bars 11*a* of the master frame (FIGS. 4 and 5). In one embodiment the upper pairs of horizontal bars 10 of the parallelogram frame 13, and vertical bars 12 connecting the lower horizontal pairs of bars 14 are of hollow-square cross-section aluminum welded together. Four vertical bars 15 of circular cross-section are connected by rigid clamps 17 (FIG. 5), to the upper and lower pairs of horizontal bars (FIGS. 4 and 5). In some embodiments the vertical bars 15, may be of hollow steel cross-section. Short horizontal bars 18, are pin connected to the lower pairs of horizontal bars, at each end of the frame. It will be apparent that with the base of the frame 13*a* caused to move outward from the building wall 7, the side elevation of the frame will take on a parallelogram configuration (FIG. 17B).

Figure 6:
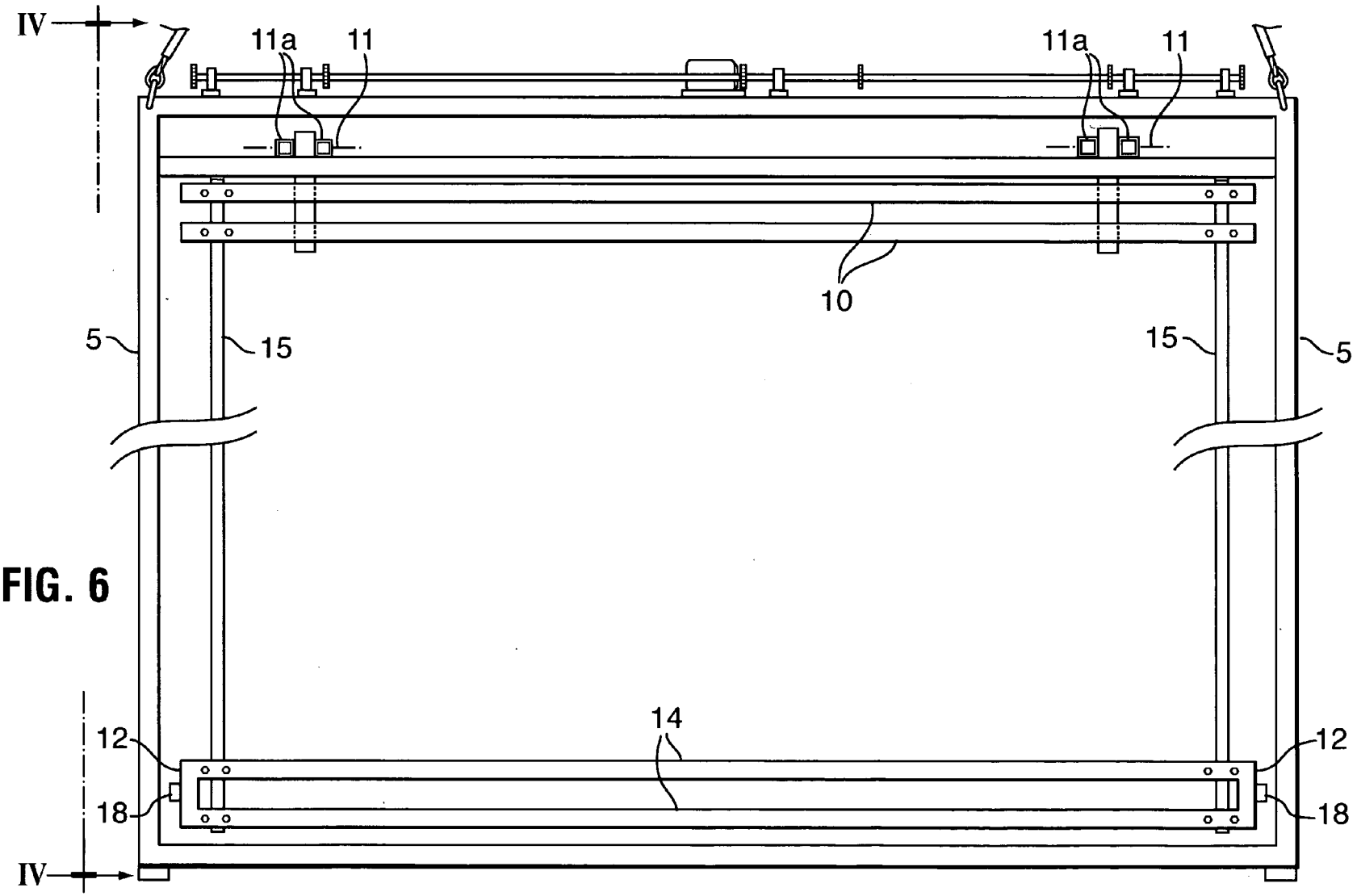
FIG. 6 is a front view of a parallelogram frame suspended inside a master frame.
Figure 7:
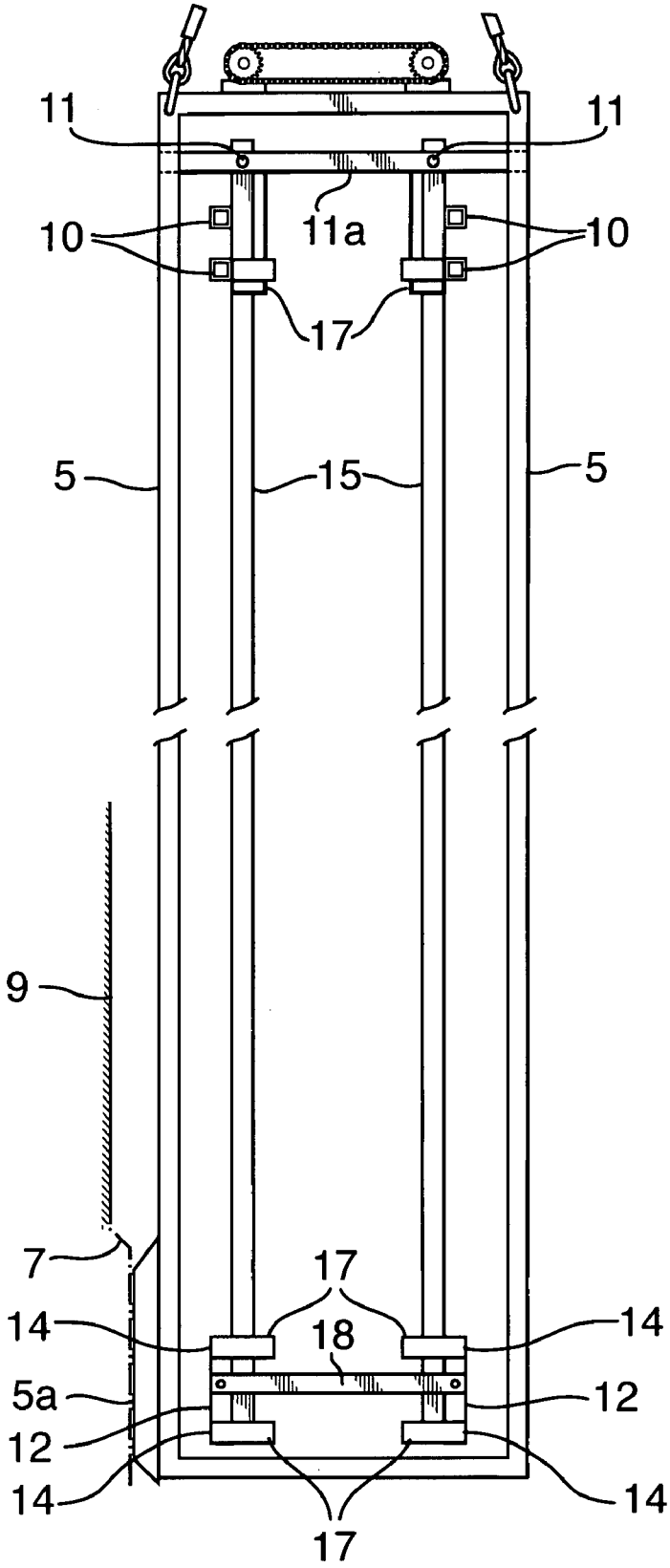
FIG. 7 is an end view taken in section along IV-IV in FIG. 6.

FIGS. 6 and 7 provide front and end views, respectively, of the assembled master and parallelogram frames.

Figure 8:
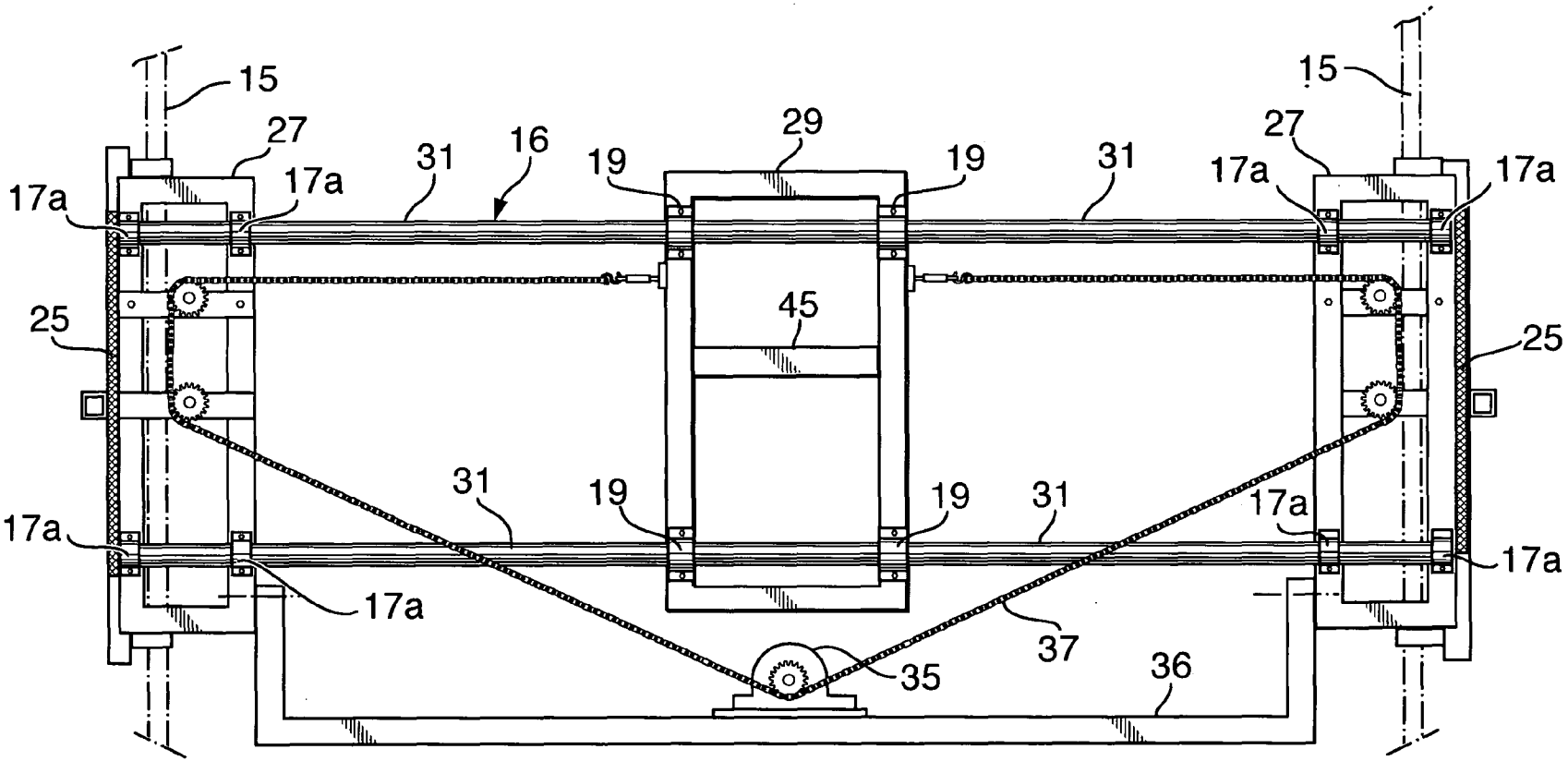
FIG. 8 is a front view of a vertically travelling main frame with section view of vertically sliding end assemblies, and carrier frame attached.

FIG. 8 provides a front view of a vertically travelling two-dimensional rectangular main frame 16. The main frame 16 is defined by two horizontal circular rails 31 rigidly attached at each end by means of clamps 17*a*, to rectangular end frames 27. A rectangular insertion tool carrier frame 29, fitted with linear bearings 19, slides back and forth along the rails 31. The horizontal motion of the carrier frame 29 is effected by a chain drive system 37, powered by a remote controlled two directional electric motor 35, resting on a motor support bracket 36 attached at each end to the main frame 16. Cross-member 45, of the carrier frame 29, provides a base for mounting the insertion tool 64 (see FIG. 13) and window cleaning tools. The main frame 16 is attached at each end to vertically sliding end assemblies 22 (FIG. 9), which are caused to slide along the vertical circular bars 15, of the parallelogram sub-frame.

Figure 9:
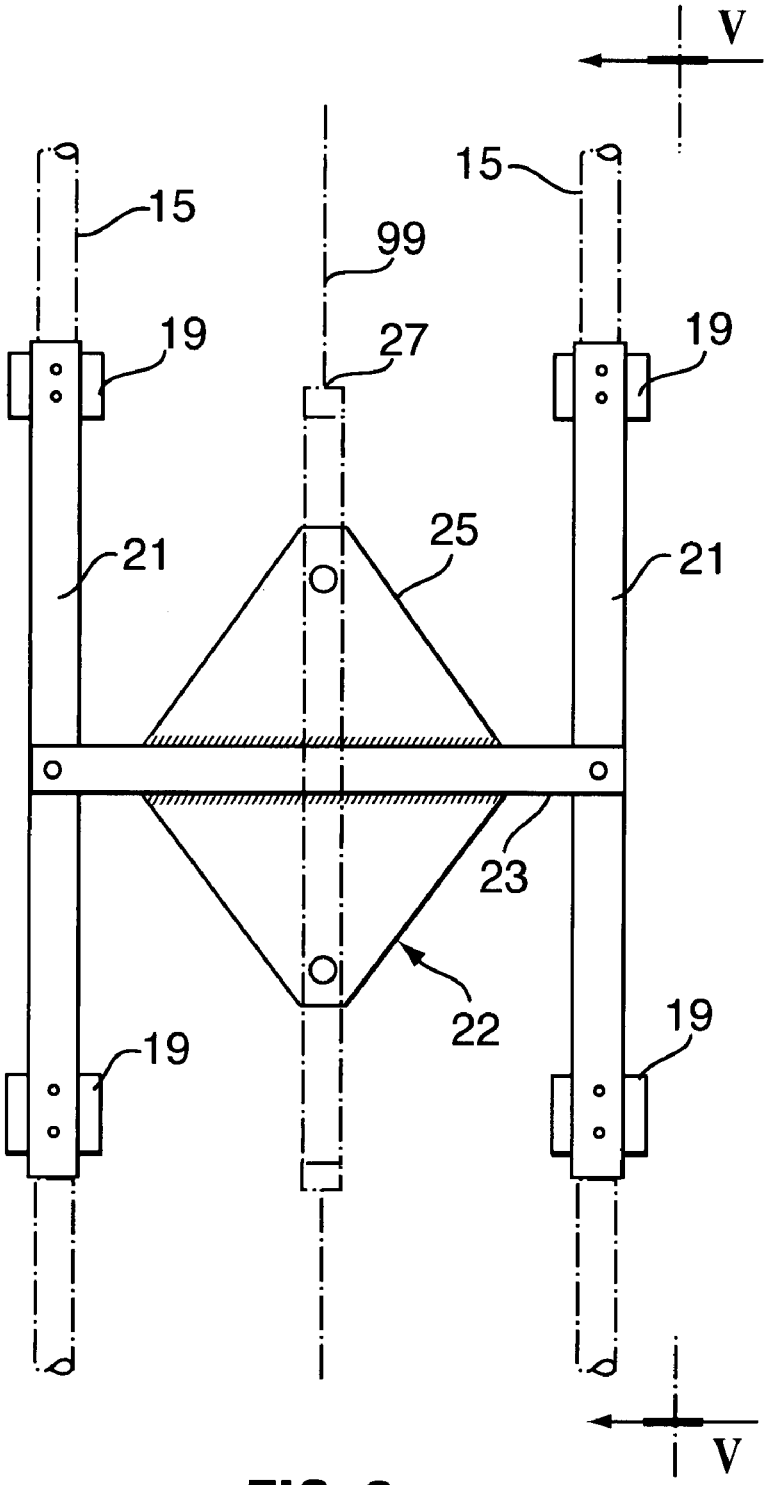
FIG. 9 is an end view of a vertically sliding end assembly.
Figure 10:
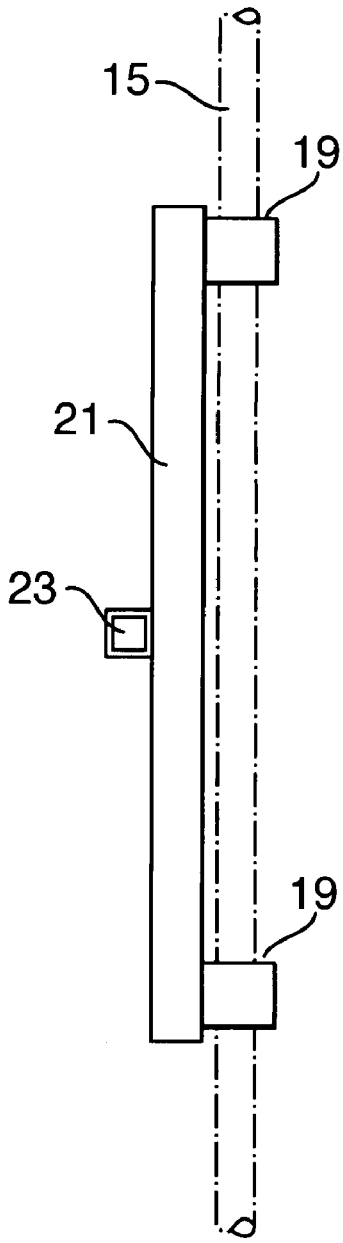
FIG. 10 is a front view taken in section along V-V in FIG. 9.

FIG. 9 provides a view of the vertically sliding end assemblies 22. Two vertical bars 21, are fitted at each extremity with linear bearings 19, which slide along pairs of adjacent vertical circular bars 15, at each end of the parallelogram sub-frame. Each end assembly 22 is fitted with a linkage bar 23, which is pin connected to the mid-points of the vertical bars 21. A thin plate, approximately diamond in shape, 25, is welded or otherwise rigidly attached to the linkage bar 23. FIG. 10 provides a view along V-V of FIG. 9. When the main frame of FIG. 8 is fully assembled, one vertically sliding end assembly 22 (FIG. 9) is rigidly attached to each end frame 27, of the main frame, along the central vertical axis of the diamond shaped plate. An edge view of the diamond shaped plates 25, is seen in FIG. 8.

Figure 11:
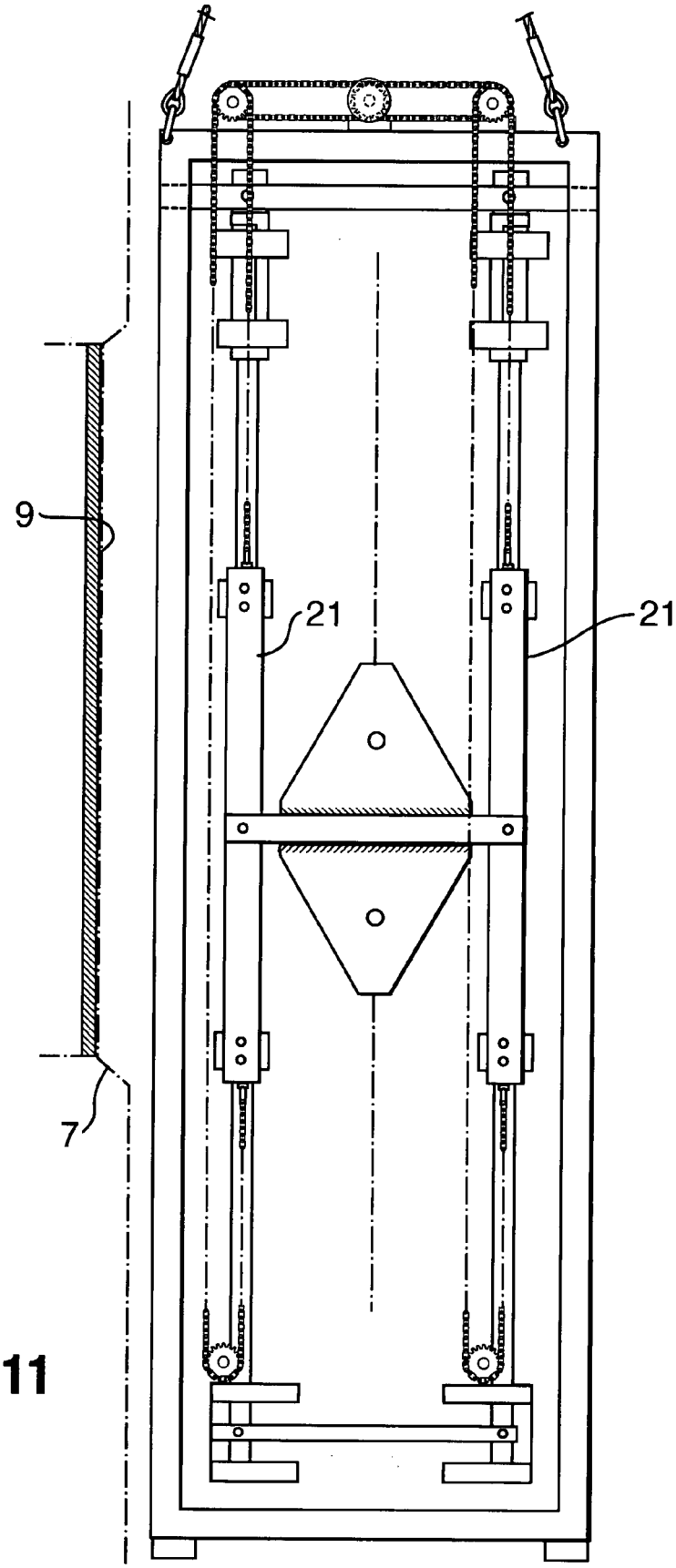
FIG. 11 is an end view of a vertical chain drive system used to raise and lower the main frame.
Figure 12:
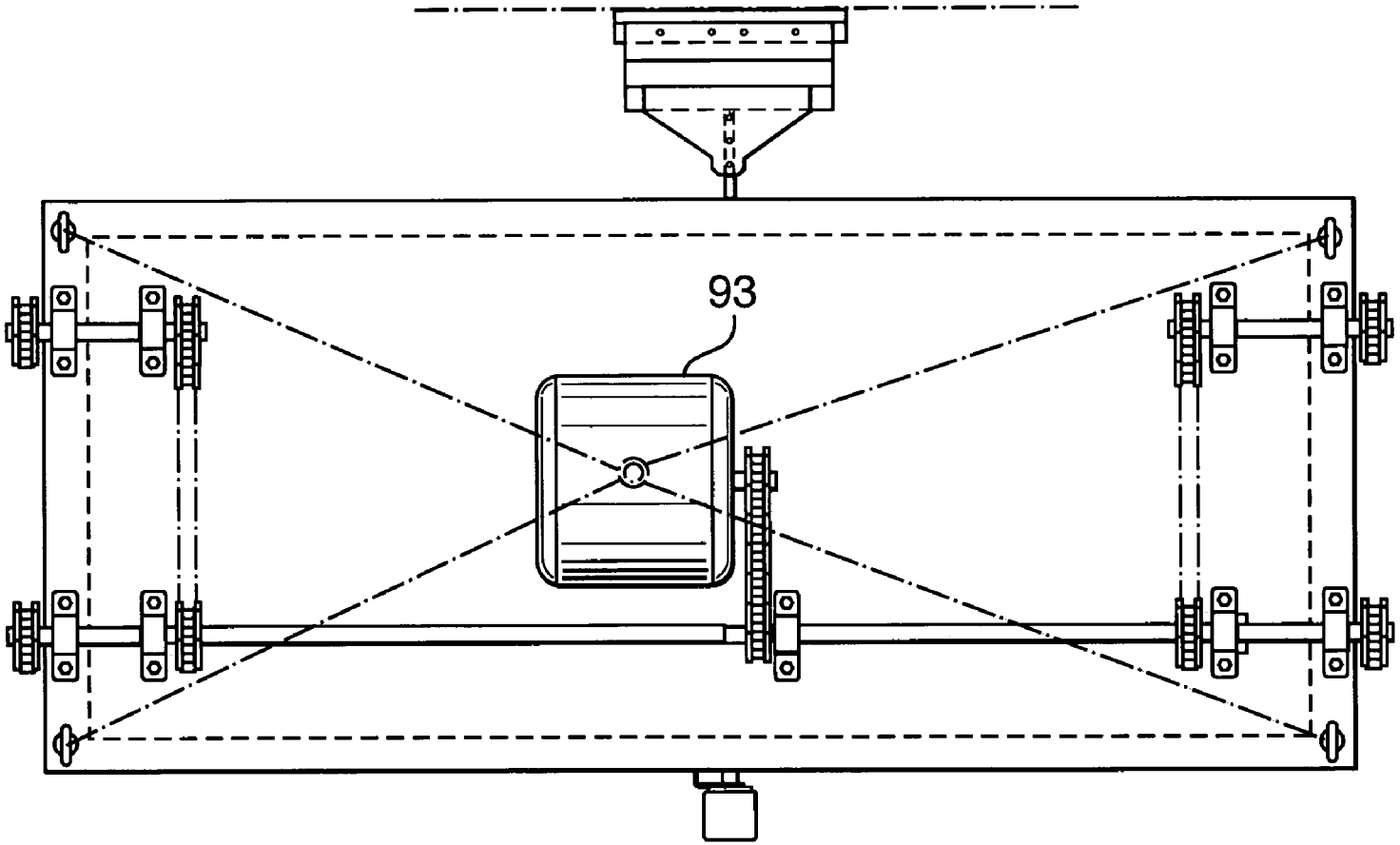
FIG. 12 is a plan view of an electric drive system mounted above a master frame for powering a vertical chain drive.

FIG. 11 presents an end view of the assembled window cleaner apparatus with the vertical chain drive system in place. The extremities of the chain loops of the figure are attached to the ends of the vertical sliding bars 21 of the vertical sliding end assemblies 22 (FIG. 9). FIG. 12 is a plan view of an electric motor and shaft arrangement used to power the vertical chain drive system of FIG. 11. It is located above the master frame and attached to it. It is driven by a two-way remote controlled electric motor 93.

Figure 13:
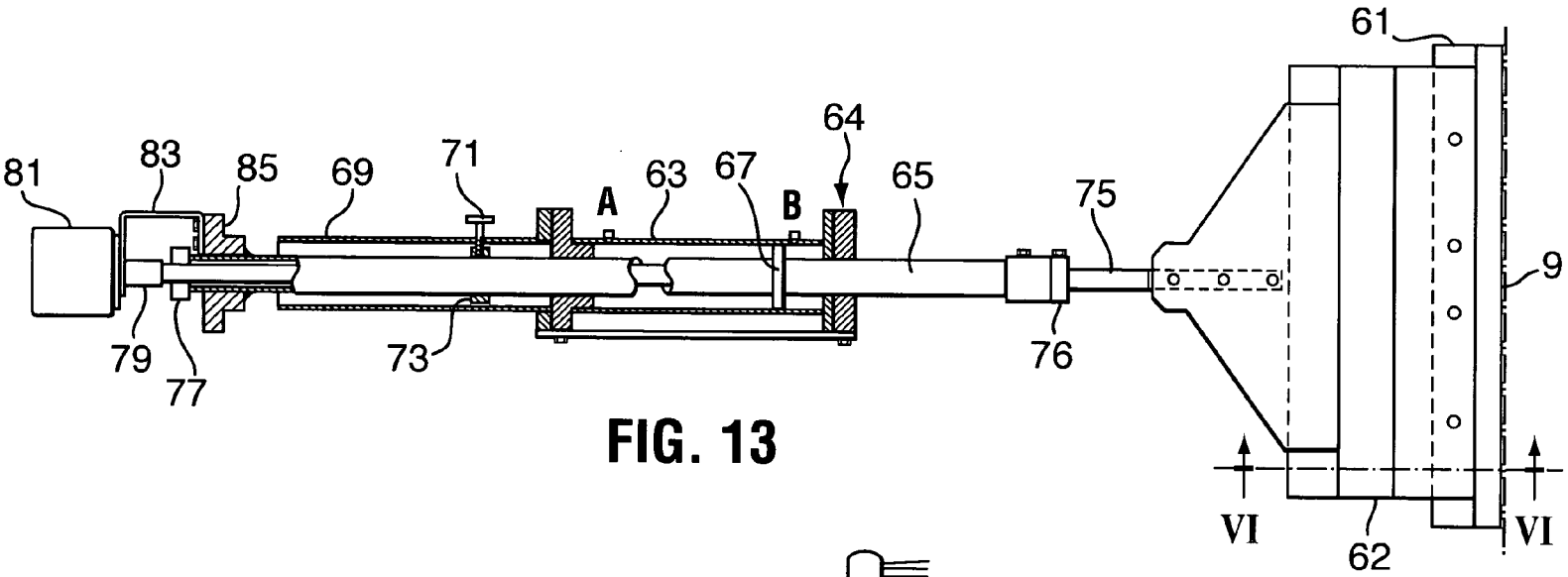
FIG. 13 is a plan view of an air-operated insertion tool with squeegee attachment.
Figure 16:
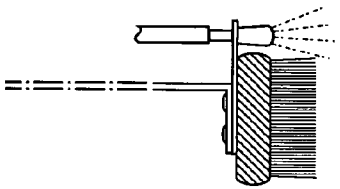
FIG. 16 is an end view in section along VII-VII in FIG. 15.
Figure 15:
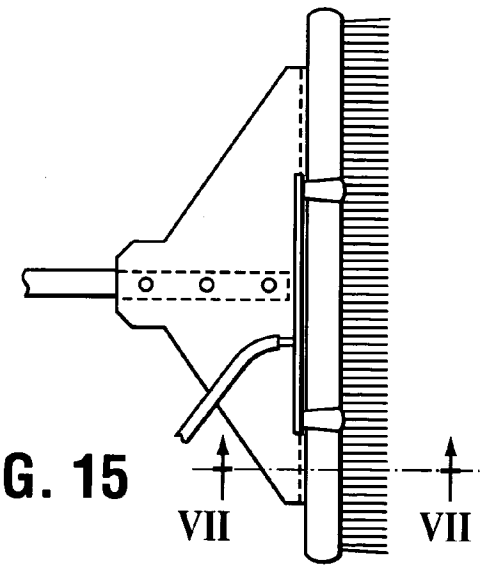
FIG. 15 is a plan view of a cleaning brush with liquid spray attachment.
Figure 14:
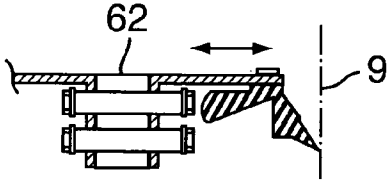
FIG. 14 is an end view taken in section along VI-VI in FIG. 13.

A plan section view of an air operated cylindrical insertion tool 64 for mounting on the insertion tool carrier frame 29 of FIG. 8 is presented in FIG. 13. It is shown with the attachment for squeegeeing 61, in place. It comprises a horizontal cylinder 63, with a thin hollow circular tube 65, passing along its axis. A short piston 67, is fixed to the hollow tube 65, and slides with an air seal contacting the inner surface of the cylinder 63, with air seals also located between the hollow tube 65, and the end caps of the horizontal cylinder 63. The cylinder is thereby divided into two phneumatic chambers A and B (FIG. 13). Pressurizing chamber A and venting chamber B causes the thin hollow tube 65, to advance toward the glaze surface 9 (FIG. 3) in preparation for the window cleaning operation. Pressurizing chamber B and venting chamber A permits withdrawal of the tube 65. An extension tube 69, is attached to one end of the horizontal cylinder 63. A narrow open slot runs along the upper surface of the extension tube. A set screw 71, passes through this slot and serves to lock an annular ring 73, against the hollow tube 65. The set screw 73, is free to slide back and forth along the slot while preventing rotation of the hollow tube 65. It may be so located as to limit the insertion depth to which the thin tube 65, can travel, if desired. A circular cylindrical rod 75, passes along the axis of the thin tube 65. It is supported near one end by the bearing 76, which in turn is attached to the thin tube. A squeegee 61, is shown attached to the outer end of this rod (FIG. 13). At the other extremity the rod 75, is supported by a bearing 77, which in turn is attached to the thin tube 65. A coupling 79, connects the rod 75, to a small remote controlled two-way electric motor 81, which permits rotation of the squeegee in either direction as desired. The electric motor is supported by a motor mounting clip 83, attached to a circular ring 85, the ring being rigidly attached to the thin tube 65. A window glaze brush with window washing fluid spray attached is shown in FIG. 15. This brushing device may be attached to the solid bar 75, of the insertion tool of FIG. 13 instead of the squeegee 61. In normal operation the window glaze will first be scrubbed with the brush and spray facility. Following this operation the glaze will be squeegeed with the squeegeeing tool 61. In one embodiment two insertion tools (FIG. 13) are mounted on the carrier frame base 45, of FIG. 8. They will either be mounted one-above-the-other, or side-by-side. One insertion tool will be fitted with the squeegee device and the other with the spray and brush attachment (FIG. 15). Each tool will be employed in turn as required, the one not in use being withdrawn to avoid interference with operation of the other. The squeegee 61, (FIG. 13) may be fitted with an elastic buffer segment 62, (FIG. 14), if desired, to add flexibility to the squeegee tool.

Figure 17A:
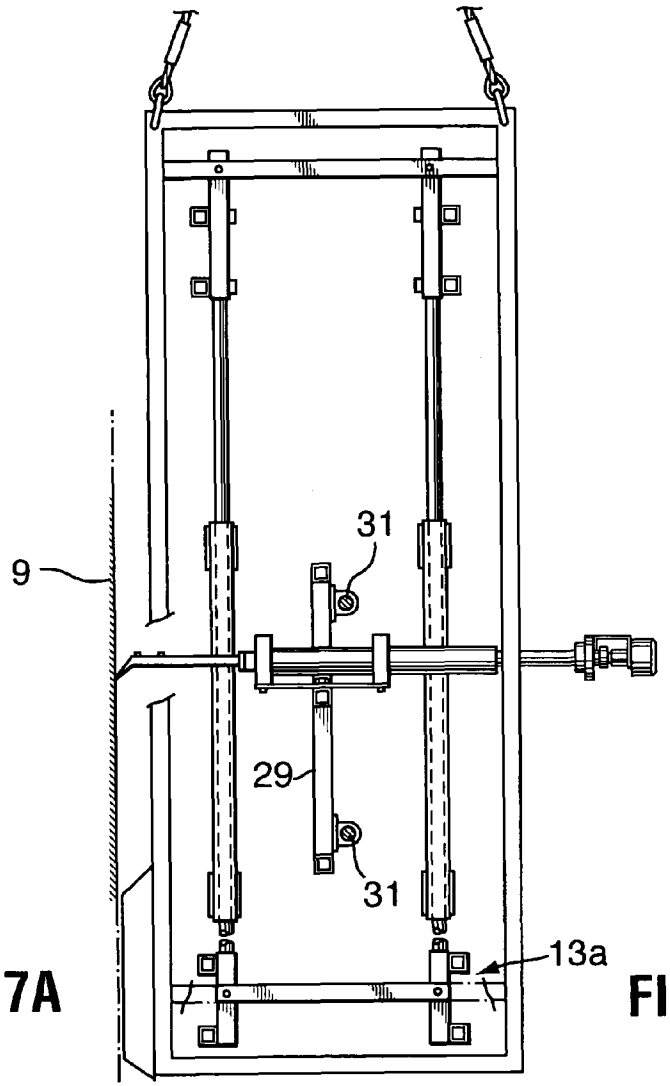
FIG. 17A is a section view taken through a remote operated window cleaning apparatus.

A section view taken through the remote operated window cleaning apparatus with the insertion tool and attached squeegee tool (FIG. 13) mounted on the carrier frame 29, is provided in FIG. 17A. The carrier frame rides along the circular bars 31 of the main frame (FIG. 8). In FIG. 17A the blade of the squeegee tool 61 has been inserted and brought to bear on the window glaze surface 9. FIG. 17B shows the same apparatus after further inward insertion action (exaggerated here for illustrative purposes). It is seen that as a result of this further insertion action the base 13*a* of the sub-frame (FIG. 5) is caused to pivot outward from the building wall forming a parallelogram shape and thereby increasing the reaction force of the squeegee blade on the glaze surface. This reaction increase is a result of gravitational forces acting on the sub-frame, the main frame, and the insertion tool. The reaction force can be adjusted to the desired level by controlling the degree of insertion imposed by the insertion tool. The required insertion can be reduced by employing counter weights 8 (FIGS. 2 and 3) cantilevered outward from the base of the parallelogram frame. Because of the design of the vertically sliding end assemblies (FIGS. 9 and 11) and the vertical chain drive system (FIG. 11) the axis of the insertion tool will always remain perpendicular to the glaze surface 9, regardless of the degree of insertion effected by the insertion tool. Furthermore, the angle of contact between the squeegee blade (FIG. 17A) and the glaze surface will remain unchanged throughout the window cleaning operation. Rotation of the squeegee is achievable because of the maintained perpendicularity between the axis of the insertion tool and the glaze surface.

Figure 18:
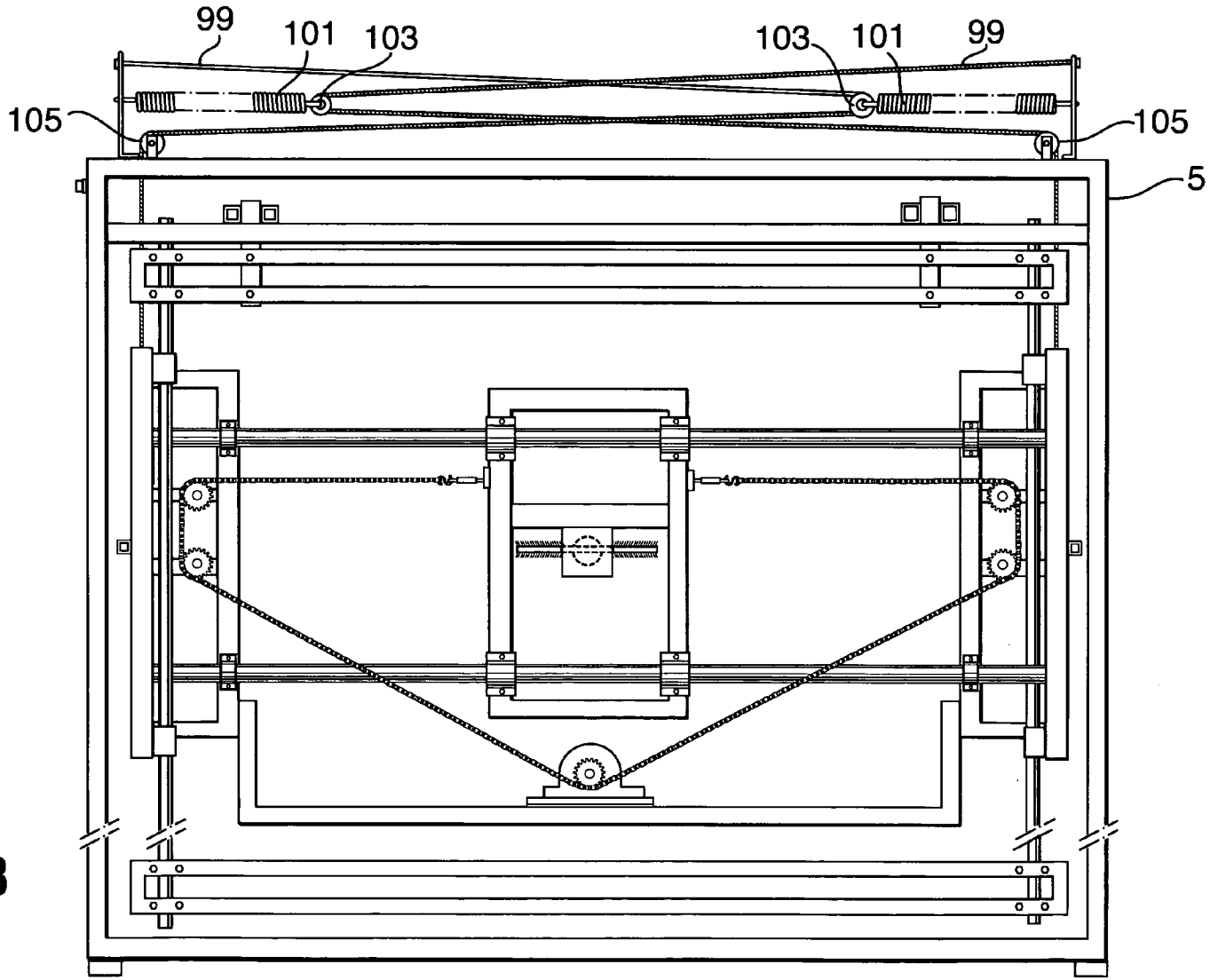
FIG. 18 is a front view of a master, parallelogram, and main frame assembly showing a vertical lift elastic spring system located along the top of the master frame.

A vertical lift elastic spring system mounted along the top of the master frame 5, is shown in FIG. 18. It comprises two horizontal coil springs 101, each anchored at one end to an outer edge of the frame, and with a small cable pulley 103, attached to the other end. Light cables 99, (FIG. 9) are also attached to the upper master frame at positions adjacent to the coil spring attachments. Each cable is threaded through the coil spring pulley 103, at the opposite edge of the frame and then passes back and through another pulley 105, attached to the master frame (FIG. 18) before descending immediately for attachment to the top of the diamond shaped plates (FIG. 9). These coil spring-cable systems function like similar systems found in conjunction with garage door opener assist systems. By proper choice of coil springs and associated cable lengths the gravitational forces acting on the vertically moving main frame are counteracted and a balance between these gravitational forces and the cable tensions can be achieved when the main frame is about half way up its vertical travel. This results in much less energy being required to effect the demanded vertical travel of the main frame and much lower loading on the elevating chains of FIG. 11.

Figure 19:
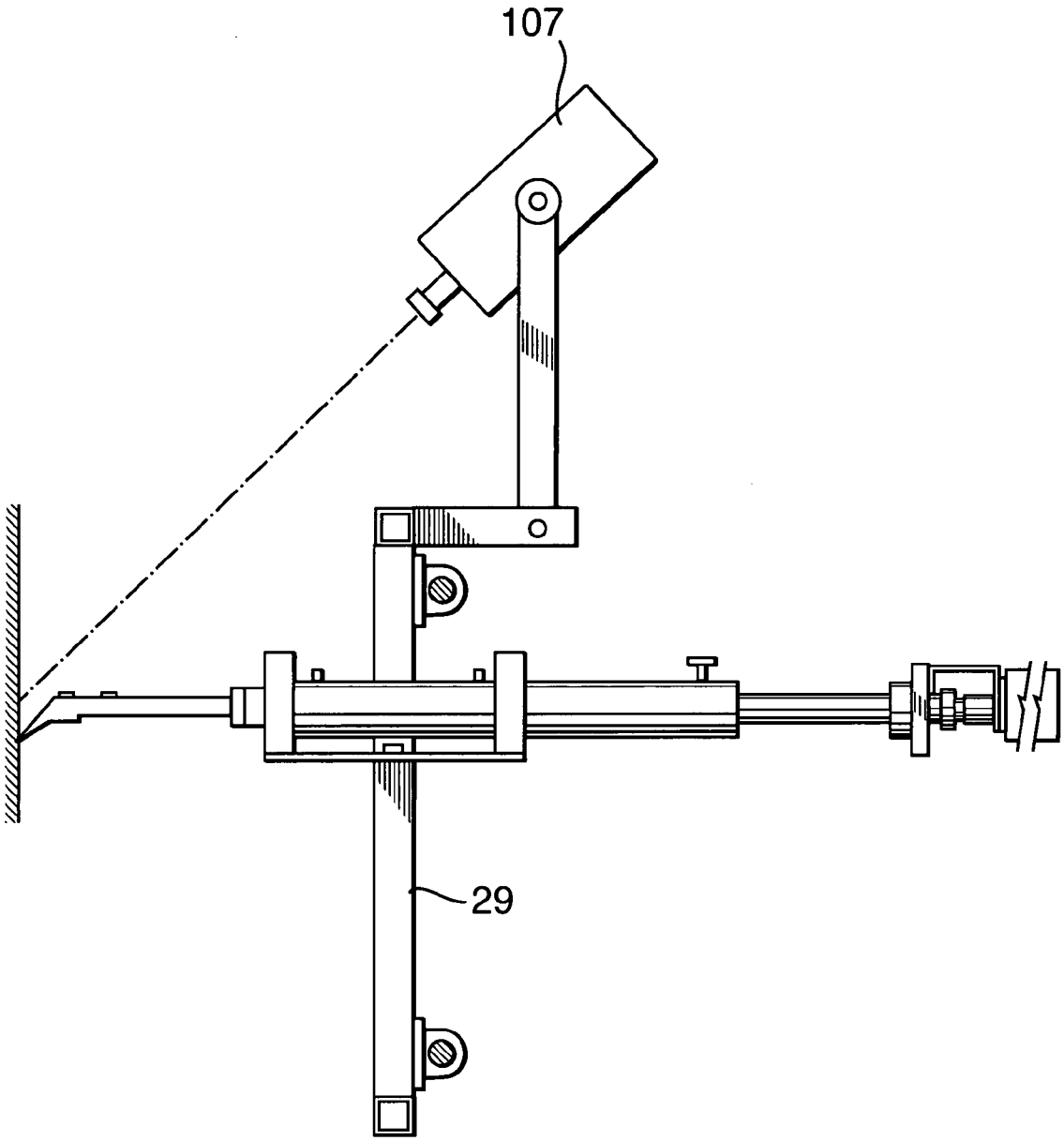
FIG. 19 is a schematic view of a closed circuit television camera mounted on an insertion tool carrier frame.

FIG. 19 presents a schematic view of a closed circuit television camera 107, mounted on a bracket attached to the insertion tool carrier frame 29, (FIG. 8), thus permitting immediate monitoring by the operator of the action of the brushing and squeegeeing tools on the glazed surface. In some embodiments another wide angle lens camera may be attached to the master frame to provide the operator at the remote control station with a global view of the entire window glaze cleaning operation.

It will be appreciated that the control means(not shown) would include a conventional console with appropriate controls. In one embodiment, the console includes a commercially available joystick for controlling the electric motors and thus the planar motion of the cleaning tools (brush and squeegee). The same joystick has a rotatable handle which permits simultaneous rotation of the brush and/or the squeegee in either direction as desired. Conventional switches, such a s simple toggle switches mounted on the console mounted on the console permit activation of the washing liquid spray pump and activation of the insertion tool for insertion or withdrawal of the cleaning tools to and from the plane of the surface to be cleaned. Other switches provide for vertical or horizontal movement of the apparatus to and from a position opposite the surface to be cleaned.

Because of the anticipated low production cost of the apparatus according to the invention, for practical purposes it is contemplated that they would be custom made to the building and its window dimensions, and could be stored, for example, on the building rooftop until ready for use, although due to the inherent versatility and range of movement capabilities of the mechanical scrubbing and scraping tools, a universal application apparatus is also within the scope of this invention.

The invention claimed is:

1. A remotely operated high rise building window glaze or building facade cleaning apparatus, comprising a rigid master frame of three-dimensional open-cage rectangular shape, for in operation being placed in a position opposite and adjacent to a surface to be cleaned, an open-cage sub-frame of similar geometry and smaller dimensions, suspended within the master frame in spaced relationship therefrom, a cylindrical insertion tool attached to the sub-frame, such that its axis remains always perpendicular to the surface to be cleaned, including activation means therefor, cleaning tools attached to the insertion tool, including washing liquid spray means, mechanical scrubbing means and mechanical scraping means, wherein the mechanical scrubbing means and mechanical scraping means are rotatable and moveable in any desired planar motion in the plane of the surface to be cleaned, a rigid main frame attached to the sub-frame for vertical travel along the sub-frame, and a carrier frame attached to the main frame for horizontal travel along the main frame, wherein the insertion tool is attached to the carrier frame, and remote control means for remotely operating the apparatus, such that in operation, the liquid spray means, mechanical scrubbing means and mechanical scraping means are sequentially brought to bear against the surface to be cleaned by said activation means.

2. An apparatus according to claim 1, wherein the sub-frame is defined by horizontally disposed upper and lower base members pivotably joined at respective upper and lower corners by vertically disposed members, such that in operation the lower base members pivot out from the plane of the surface to be cleaned, thereby forming a parallelogram shape.

3. An apparatus according to claim 2, wherein the main frame is of two dimensional rectangular shape defined by horizontal bars slideably attached at each end to vertical traveling assemblies for vertical up and down travel on the vertical members of the sub-frame.

4. An apparatus according to claim 3, including first drive means associated with the main frame for providing vertical travel, and second drive means associated with the carrier frame for providing horizontal travel.

5. An apparatus according to claim 4, wherein the vertically traveling assemblies are driven by the first drive means, such that each assembly is caused to undergo identical uniform vertical motion along vertically disposed members of the sub-frame.

6. An apparatus according to claim 5, wherein the first and second drive means both comprise a chain-sprocket drive system.

7. An apparatus according to claim 6, wherein cantilevered counter weights are provided on the sub-frame to increase pressure of the mechanical scrubbing means and/or the mechanical scraping means on the surface to be cleaned, as required.

8. An apparatus according to claim 7, including building wall contact means attached to the master frame, to maintain sustained and stable positioning of the apparatus during the cleaning operation.

9. An apparatus according to claim 8, wherein the master frame is suspended from a building rooftop by a cable, wherein movement of the master frame is controlled by the remote control means.

10. An apparatus according to claim 9, wherein the cylindrical insertion tool comprises separate first and second insertion tools, one carrying the mechanical scrubbing means and the other carrying the mechanical scraping means.

11. An apparatus according to claim 10, wherein the mechanical scrubbing means is a brush and the mechanical scraping means is a squeegee.

12. An apparatus according to claim 11, wherein the building wall contact means is in the form of pads attached to lower corners of the master frame.

13. An apparatus according to claim 12, wherein the washing liquid spray means includes a reservoir for washing liquid and a liquid spray pump associated therewith.

14. An apparatus according to claim 13, wherein the remote control means includes two-way electric motors for operating the first and second drive means, the insertion tool activation means, the washing liquid spray pump, and for effecting rotation of the mechanical scrubbing means and the mechanical scraping means, and a closed circuit television monitoring system including cameras and a television receiver.

15. A remotely operated high rise building window glaze or building facade, cleaning apparatus comprising, a rigid master frame of three-dimensional open-cage rectangular shape, adapted to be vertically lowered or raised by means of a suspension cable to and from a cleaning position opposite the window glaze or building facade to be cleaned, wherein the open-cage master frame is defined by horizontally disposed upper and lower members joined at respective upper and lower corners by vertically disposed members, and including building wall contact means attached to the inside lower corners to maintain positioning of the master frame in a stationary position during the cleaning operation, an open-cage sub-frame of similar geometry and of smaller dimensions suspended within the master frame in spaced relationship therefrom, wherein the open-cage sub-frame is defined by horizontally disposed upper and lower base members pivotably joined at respective upper and lower corners by vertically disposed members, and wherein the lower corners are pin jointed in such a way that in operation the lower base members pivot out from the building facade, thereby forming a parallelogram shape, a rigid two-dimensional rectangular shaped main frame defined by horizontal rails, attached at each end to vertical travelling end assemblies fitted with linear bearings, the linear bearings being slideable up and down the vertical corner rails of the sub-frame at the same rate, wherein vertical travel of the bearings is effected by a first drive system, the first drive system being so designed that the main frame always travels in a vertical plane, though this plane of travel will be moved horizontally outward from the building facade as the base of the sub-frame pivots outward, a carrier frame slideable horizontally along the main frame by means of linear bearings fitted on the horizontal rails of the main frame, such that horizontal motion of the carrier frame is effected by means of a second drive system mounted on the main frame, a cylindrical insertion tool mounted on the carrier frame such that its axis remains always perpendicular to the surface to be cleaned, including activation means therefor, cleaning tools attached to the insertion tool, including washing liquid spray means, mechanical scrubbing means and mechanical scraping means, such that in operation, the liquid spray means mechanical scrubbing means and mechanical scraping means are sequentially brought to bear on the surface to be cleaned by said activation means, wherein further increasing the insertion tool travel toward the window glaze causes the parallelogram frame to move outward at its base thereby increasing the pressure of the mechanical scrubbing means and/or the mechanical scraping means on the surface to be cleaned to a desired level, and remote control means for remotely operating the apparatus.

16. An apparatus according to claim 15, wherein the first and second drive means both comprise a chain-sprocket drive system.

17. An apparatus according to claim 16, additionally comprising a pair of coil springs mounted horizontally on the upper members of the master frame connected to a pair of cables, wherein the cables pass over pulleys and downward where they are connected to the main frame.

* * * * *